US011572802B2

(12) United States Patent
Hu et al.

(10) Patent No.: US 11,572,802 B2
(45) Date of Patent: Feb. 7, 2023

(54) STEAM TURBINE HAVING A STEAM SUPPLEMENTING STRUCTURE AND OPERATING METHOD THEREFOR

(71) Applicant: Shanghai Electric Power Generation Equipment Co., Ltd., Shanghai (CN)

(72) Inventors: Yifeng Hu, Shanghai (CN); Gang Chen, Shanghai (CN); Xingzhu Ye, Shanghai (CN); Kai Cheng, Shanghai (CN)

(73) Assignee: SHANGHAI ELECTRIC POWER GENERATION EQUIPMENT CO., ETD., Shanghai (CN)

( * ) Notice: Subject to any disclaimer, the term of this patent is extended or adjusted under 35 U.S.C. 154(b) by 25 days.

(21) Appl. No.: 17/288,391

(22) PCT Filed: Apr. 2, 2019

(86) PCT No.: PCT/CN2019/081015
§ 371 (c)(1),
(2) Date: Apr. 23, 2021

(87) PCT Pub. No.: WO2020/093648
PCT Pub. Date: May 14, 2020

(65) Prior Publication Data

US 2021/0381395 A1 Dec. 9, 2021

(30) Foreign Application Priority Data

Nov. 6, 2018 (CN) ..... 201811313093.8

(51) Int. Cl.
*F01D 25/12* (2006.01)
*F01D 25/14* (2006.01)
*F01D 25/26* (2006.01)

(52) U.S. Cl.
CPC ..... *F01D 25/12* (2013.01); *F01D 25/14* (2013.01); *F01D 25/26* (2013.01); *F05D 2220/31* (2013.01)

(58) Field of Classification Search
CPC ..... F01D 25/12; F01D 25/14; F01D 25/26; F05D 2220/31; F05D 2220/72
See application file for complete search history.

(56) References Cited

U.S. PATENT DOCUMENTS 2,796,231 A 6/1957 Hertl
2,823,891 A * 2/1958 Baker ..... F01D 3/02 415/93

(Continued)

FOREIGN PATENT DOCUMENTS

CN 101052782 A 10/2007
CN 109184823 A 1/2019

OTHER PUBLICATIONS

International Search Report and Written Opinion dated May 14, 2020 in PCT International Application No. PCT/CN2019/081015. (English translation of International Search Report).

*Primary Examiner* — Courtney D Heinle
*Assistant Examiner* — Andrew Thanh Bui
(74) *Attorney, Agent, or Firm* — Amster, Rothstein & Ebenstein LLP

(57) ABSTRACT

A steam turbine having a steam supplementing structure and an operating method therefor. The steam turbine includes an outer casing and an inner casing, a rotor having a thrust balancing piston, the rotor being rotatably mounted inside the inner casing; and a steam flow channel formed between the inner casing and the rotor. Impeller blades fitted with the rotor and a plurality of guide blades fitted with the inner casing are alternately arranged to form multiple stages of blade groups. Steam is fed from the steam throughflow downstream of a first designated blade staging in multiple (Continued)

stages of blade groups to a thrust balancing piston chamber disposed between the inner casing and the thrust balancing piston of the rotor. An interlayer for the steam to circulate is formed between the inner casing and the outer casing, the interlayer including a supplemental steam chamber which can receive the steam from a sealed chamber between the rotor and the inner casing. The steam is mixed with supplemental steam fed into the steam supplementing chamber via steam supplementing pipelines. The mixed steam then returns, via the communicating pipe in the inner casing, to the steam throughflow downstream of the second designated blade staging in the flow channel.

16 Claims, 4 Drawing Sheets

(56) References Cited

U.S. PATENT DOCUMENTS

| | | | | |
|---|---|---|---|---|
| 2,905,434 | A * | 9/1959 | Hertl | F01D 25/26<br>415/209.2 |
| 3,614,255 | A | 10/1971 | Rooney | |
| 8,202,037 | B2 * | 6/2012 | Deidewig | F01D 3/04<br>415/58.7 |
| 2021/0381394 | A1 * | 12/2021 | Tang | F01D 5/02 |

* cited by examiner

STEAM TURBINE HAVING A STEAM SUPPLEMENTING STRUCTURE AND OPERATING METHOD THEREFOR

CROSS-REFERENCE TO RELATED APPLICATIONS

This application is a U.S. national stage entry under 35 U.S.C. § 371 of PCT International Patent Application No. PCT/CN2019/081015, filed Apr. 2, 2019, which claims priority to Chinese Patent Application No. 201811313093.8, filed Nov. 6, 2018, the contents of each of which are incorporated herein by reference in their entirety.

TECHNICAL FIELD

Embodiments of the present disclosure relate to a steam turbine having a steam supplementing structure and an operating method therefor.

BACKGROUND

A steam turbine is a rotary steam-powered machine, customarily comprising a rotatably mounted rotor fitted with blades, the rotor being installed inside a casing shell. When heated and pressurized steam is flowing through a flow space formed by the casing shell, the rotor is set in rotation via the blades.

For reasons of efficiency, operating parameters (e.g., steam pressure and steam temperature) of the steam turbine become increasingly high; however, heat resistance property of the steam turbine is limited by the strength and material of its component parts. To guarantee reliable operation at an especially high temperature, the component parts need to be cooled individually. Without efficient cooling in the case of temperature rise, the component parts have to be manufactured with significantly more expensive materials (for example, nickel-based alloys).

In the hitherto known cooling methods, especially for the component parts (such as casing or rotor) of the steam turbine, a distinction is to be made between an active cooling and a passive cooling. In the case of active cooling, the cooling is effectuated by a cooling medium which is fed separately (i.e., in addition to a working medium) to the component parts. In contrast, the passive cooling takes place purely by means of a suitable guiding or by application of the working medium. Up to now, the component parts of conventional steam turbines have been preferably passively cooled.

The patent CN200580033477.9 discloses a steam turbine (as shown in FIG. 1), wherein the steam turbine comprises: an outer casing 2 and an inner casing 3, wherein the outer casing 2 and the inner casing 3 are provided with a live steam feed channel 10; and a rotor 5 rotatably mounted inside the inner casing 3, the rotor 5 having a thrust balancing piston 4 and comprising a plurality of impeller blades 7; wherein a plurality of guide blades 8 are arranged on the inner casing 3 in such a manner that the plurality of guide blades 8 form, in a flow direction 11, a steam flow channel 9 comprising one or more blade stages; after traversing one blade stage, the steam flows through a return channel 14 within the inner casing 3 into a chamber 15 between the inner casing 3 and the outer casing 2, and then from the chamber 15, flows through a feed channel 16 within the inner casing 3 into a thrust balancing piston antechamber 12 that is disposed in an axial direction 17 between the thrust balancing piston 4 and the inner casing 3; and wherein thrust balance is achieved via the steam in the thrust balancing piston antechamber 12.

The live steam feed is shown symbolically by the arrow 13; the live steam admitted into the live steam feed channel 10 flows for the most part along the flow direction into the flow channel 9, while a smaller part flows as leakage steam into a sealed chamber 18 disposed between the rotor 5 and the inner casing 3. In this case, the leakage steam flows substantially along a counter direction 19. The steam in the sealed chamber 18 flows through a cross-return channel 20 arranged in the inner casing 3 into an inflow cavity 26 which is disposed downstream of one blade stage, wherein symbols 21, 22 represent two turns of the cross-return channel 20; meanwhile, supplemental steam flows into the inflow cavity 26 via a load inlet pipe 23 which extends through the outer casing 2 and the inner casing 3. The return channel 14, after traversing one return blade stage 24, is connected to the flow channel 9; and the cross-return channel 20, after traversing one cross-return blade stage 25, is connected to the flow channel 9, wherein the cross-return blade stage 25 is disposed downstream of the return blade stage 24 along the flow direction 11 of the flow channel 9.

In a practical application of the steam turbine having the cooling structure described above, as shown in FIG. 2, the steam supplementing pipeline 24' and the cross-return channel 20' are connected in the inner casing 3' via a steam supplementing chamber 27'; meanwhile, supplemental steam and cooling steam are fed into the steam throughflow via the pipeline 23'. Such s structure usually causes a serious vibration problem in practical operations. As shown in FIG. 3, the supplemented steam to the steam turbine is directly admitted through the steam supplementing pipeline 24' into the inner casing 3' via two lines of inserted tubes from two sides of the steam turbine; thanks to the split structure of the inner casing, the two lines of supplemental steam are separately admitted into two independent steam supplementing chambers 27' of the inner casing 3'. However, as the ball cavity structure of the steam supplementing valve is designed differently from the pipelines at two sides, throughput and pressure differentials exist between the two lines of supplemental steam, resulting in occurrence of excitation and inhomogeneous throughput of the supplemental steam in the pipelines 23' at the two sides and in the steam throughflow, thereby causing steam turbine vibration.

The patent CN201480046503.0 discloses the cause for the vibration and provides a solution of additionally mounting a regulation valve and a vibration detection sensor respectively to the steam supplementing pipelines at both sides. As shown in FIG. 5, a first valve 33 and a second valve 34 are respectively provided for the two steam supply pipelines 35, 36 of the steam turbine 32, such that when the first valve 33 and/or the second valve 34 vibrate, the first valve 33 is regulated toward the Close direction, and the second valve 34 is regulated toward the Open position.

SUMMARY OF THE INVENTION

Embodiments of the present disclosure provide a steam turbine having a steam supplementing structure and an operating method therefor, which, by optimizing the internal cooling pipelines and the steam supplementing structure in the inner casing, overcome the vibration issue occurring when the steam supplementing valve is opened during running of the steam turbine.

In one aspect, there is provided a steam turbine having a steam supplementing structure, the steam turbine comprising an outer casing and an inner casing, a rotor having a thrust balancing piston, the rotor being rotatably mounted inside the inner casing; and a steam flow channel formed between the inner casing and the rotor, wherein a plurality of impeller blades fitted with the rotor and a plurality of guide blades fitted with the inner casing are alternately arranged to form multiple stages of blade groups; an interlayer for steam to circulate is formed between the inner casing and the outer casing; the interlayer between the inner casing and the outer casing includes a steam supplementing chamber that is connected to a plurality of lines of steam supplementing pipelines for conveying supplemental steam to the steam turbine; and a communicating pipe for the steam to circulate is provided between the steam supplementing chamber and the flow channel.

Optionally, the steam supplementing chamber is an annular steam supplementing chamber.

Optionally, the section in the steam supplementing chamber closer to the communicating pipe has a larger steam accommodation space.

Optionally, the multiple stages of blade groups include a first set blade staging and a second set blade staging; and a sealed chamber is provided between the rotor and the inner casing;

the steam turbine is provided with a first steam channel inside the inner casing, the first steam channel connecting the steam throughflow downstream of the first set blade staging to a thrust balancing piston chamber formed between the thrust balancing piston and the inner casing;

the steam turbine is further provided with a second steam channel, the second steam channel comprising: a pipeline connecting the sealed chamber to the interlayer between the inner casing and the outer casing, the interlayer, the steam supplementing chamber of the interlayer, and the communicating pipe connecting the interlayer to the steam throughflow downstream of the second set blade staging.

Optionally, the second set blade staging is disposed downstream of the first set blade staging in the flow channel.

Optionally, the first set blade staging corresponds to the fourth blade stage in the flow channel, and the second set blade staging corresponds to the fifth blade stage in the flow channel.

Optionally, a plurality lines of the communicating pipes are distributed at the circumference of the inner casing.

Optionally, the first steam channel first extends in the inner casing in the axial direction substantially perpendicular to the rotor, and after the first turn, extends substantially parallel to the axial direction, and then after the second turn, extends substantially perpendicular to the axial direction.

In the second steam channel, a pipeline connecting the sealed chamber to the interlayer between the inner casing and the outer casing extends along the axial direction substantially perpendicular to the rotor, and a communicating pipe connecting the interlayer to the steam throughflow downstream of the second set blade staging extends substantially perpendicular to the axial direction.

Optionally, a plurality of lines of the steam supplementing pipelines pass through the outer casing, respectively, to communicate with the steam supplementing chamber.

Another technical solution of the present disclosure is to provide an operating method for a steam turbine, applicable to any steam turbine having a steam supplementing structure described above, an inner casing and an outer casing of the steam turbine being provided with a live steam feed channel, the method comprising:

feeding live steam into an inlet steam chamber inside the inner casing via the live steam feed channel, wherein the live steam starts from the inlet steam chamber into a flow channel between the inner casing and the rotor, and circulates around respective blade stage so as to be expanded and cooled, thereby releasing heat energy to drive the rotor to rotate;

conveying, via a first steam channel provided in the inner casing of the steam turbine, the steam from the steam throughflow downstream of a first designated blade staging in multiple stages of blade groups to a thrust balancing piston chamber disposed between the inner casing and the thrust balancing piston of the rotor so as to generate a counter force reacting to a rotor thrust;

conveying, via a second steam channel of the steam turbine, the steam from the sealed chamber disposed between the rotor and the inner casing into the steam supplementing chamber in the interlayer between the inner casing and the outer casing so as to mix with the supplemental steam externally fed into the steam supplementing chamber via a plurality of lines of steam supplementing pipelines, wherein the mixed steam then returns from the communicating pipe disposed in the inner casing to the steam throughflow downstream of the second designated blade staging to continue working.

The steam turbine having a steam supplementing structure and the operating method therefor according to the embodiments of the present disclosure offer the following advantages over conventional technologies:

Embodiments of the present disclosure enable the steam in the cooling structure to reverse the flow direction: in a conventional cooling structure design, the steam is admitted from the steam throughflow at the preceding blade stage into the balancing piston through the interlayer between the inner casing and the outer casing via a pipeline, and then passes through the balancing piston and returns from the internal pipeline in the inner casing to the steam throughflow at the next blade stage; however, in the present disclosure, the steam is admitted from the steam throughflow at the preceding blade stage into the balancing piston via the internal pipeline in the inner casing, and then circulates in a loop through the interlayer between the inner casing and the outer casing till reaching the steam throughflow at the next blade stage.

Embodiments of the present disclosure eliminates the conventionally provided steam supplementing chamber and steam inlet pipes inserted in the steam supplementing valve pipelines; instead, an appropriate steam supplementing chamber (e.g., an annular steam supplementing chamber) is provided in the interlayer between the inner casing and the outer casing. In the conventional steam supplementing structure, the supplemental steam flows into the casing passages in two lines from the steam supplementing valve; due to the split structure of the inner casing, the two lines of supplemental steam are respectively admitted into two independent steam supplementing chambers of the inner casing; however, due to throughput and pressure differentials existing between the two lines of supplemental steam, vibration occurs. Embodiments of the present disclosure enable the supplemental steam to be mixed between the inner casing and the outer casing, which eliminates the throughput and pressure differentials and thus overcomes the vibration issue upon opening of the steam supplementing valve.

Compared with the conventional supplemental steam valve pipeline rebuild solution, the present disclosure eliminates the need of a high temperature regulation valve and a vibration detection sensor, which thus has a lower cost; the present disclosure does not need a specific regulation logic and method and is thus easily implemented. The conventional high temperature regulation valve has issues such as jamming and failure, while the novel solutions provided by the present disclosure is safer and more reliable.

DETAILED DESCRIPTION OF EMBODIMENTS

To overcome the issue of large stage vibration when the steam supplementing valve is opened during operation of the conventional steam turbine structure, embodiments of the present disclosure provide a steam turbine having a steam supplementing structure and an operating method thereof.

Figure 1:
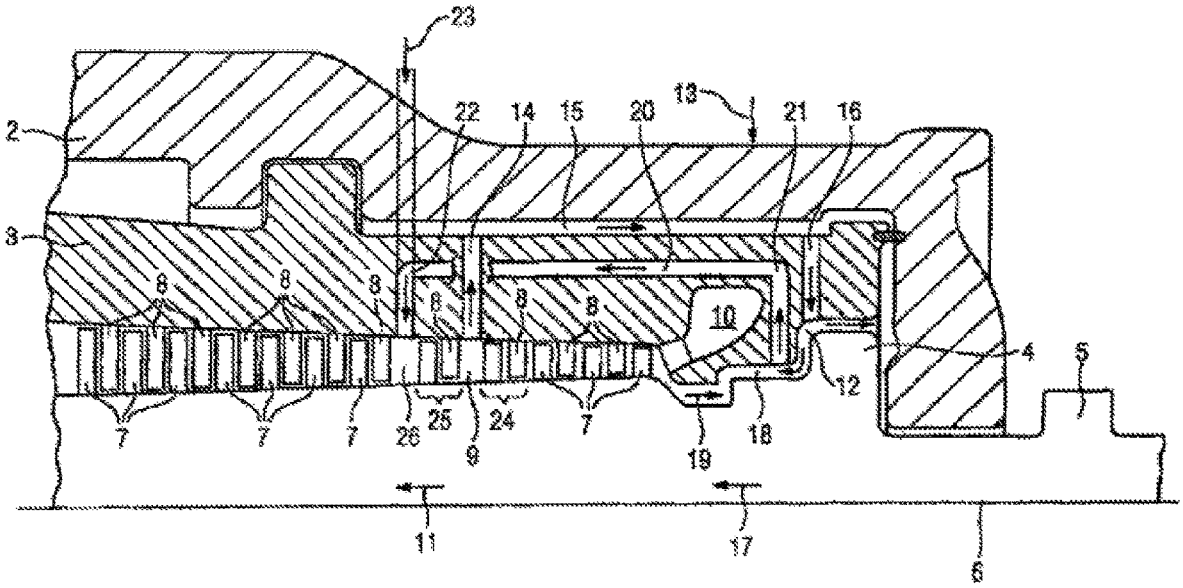
FIG. 1 is a local sectional view of a conventional steam turbine.
Figure 2:
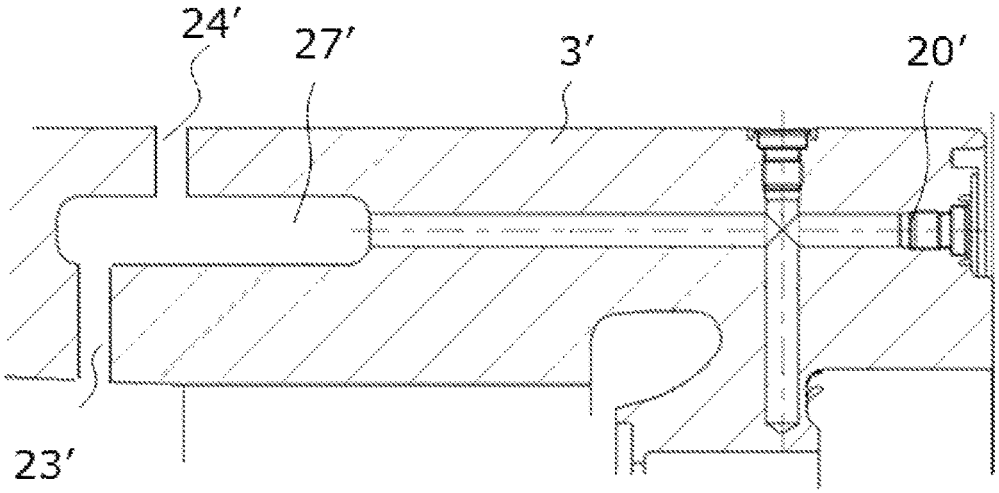
FIG. 2 is a local sectional view corresponding to the steam supplementing structure when the conventional steam turbine is running.
Figure 3:
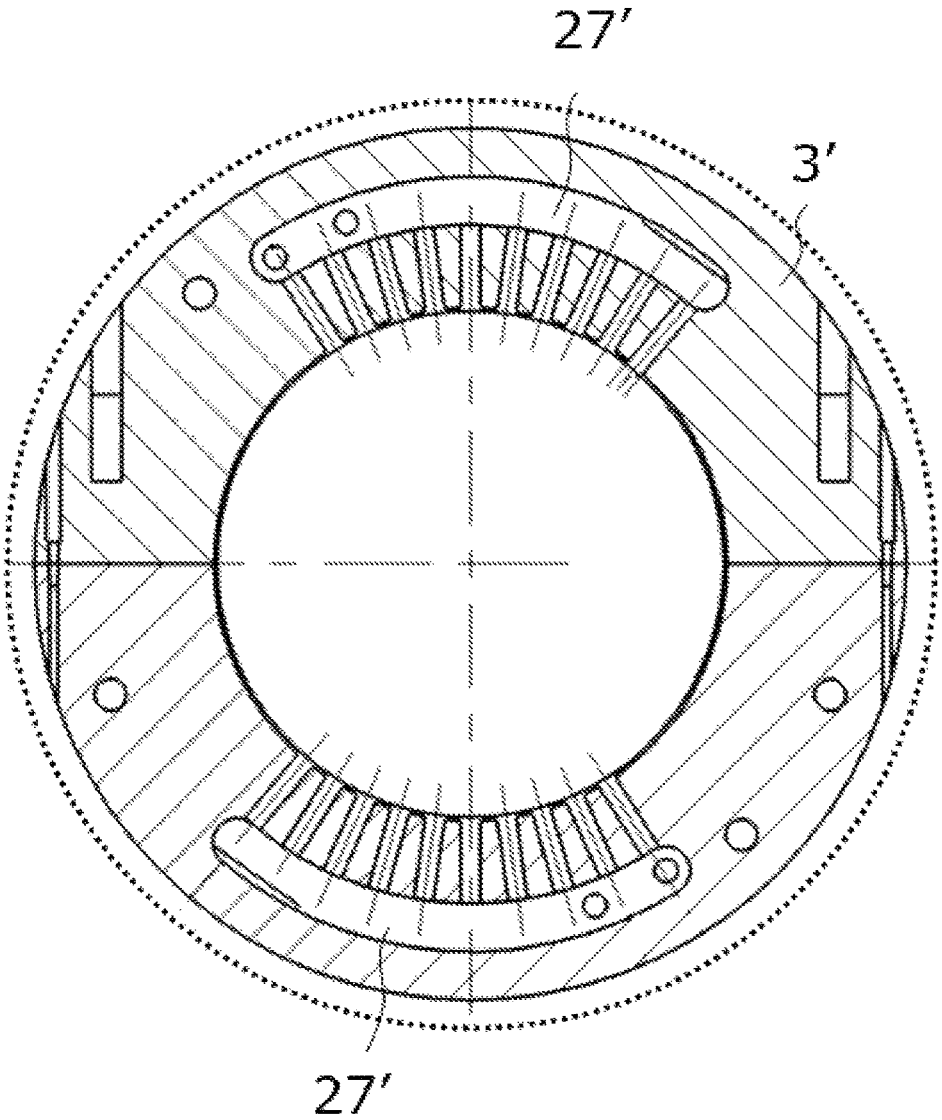
FIG. 3 is a radial sectional schematic diagram of the inner casing in the steam supplementing structure shown in FIG. 2.
Figure 4:
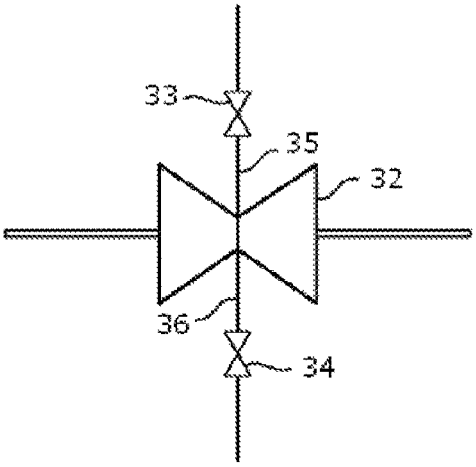
FIG. 4 is an implementation schematic diagram of the steam supplementing structure of a conventional steam turbine when solving the vibration issue.
Figure 5:
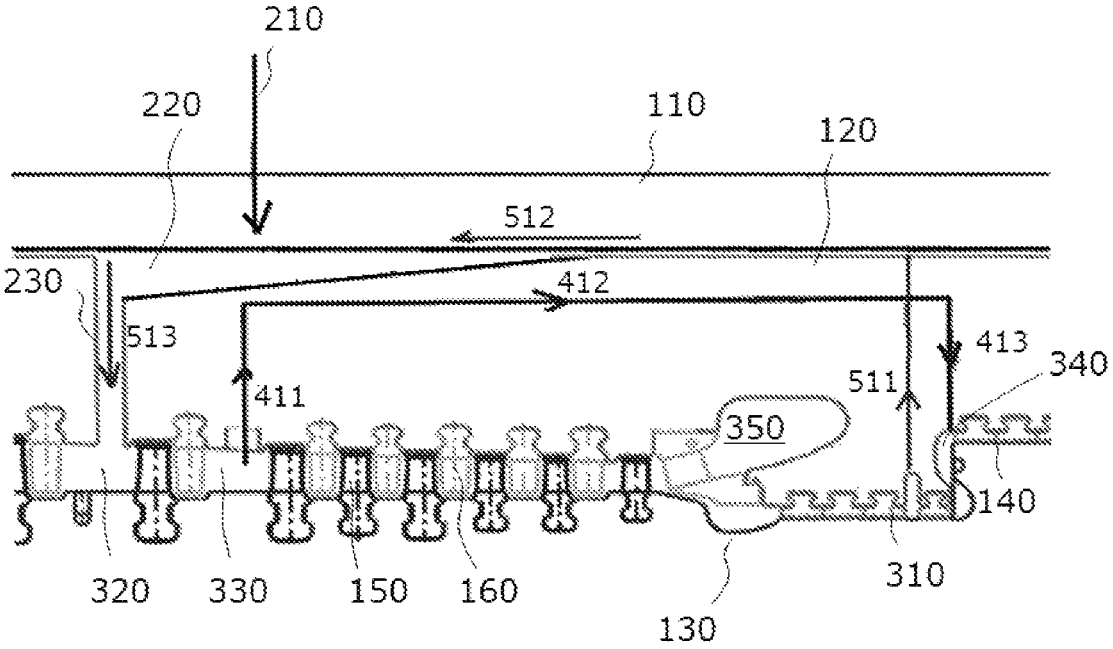
FIG. 5 is a local sectional view of a steam turbine according to the present disclosure.
Figure 6:
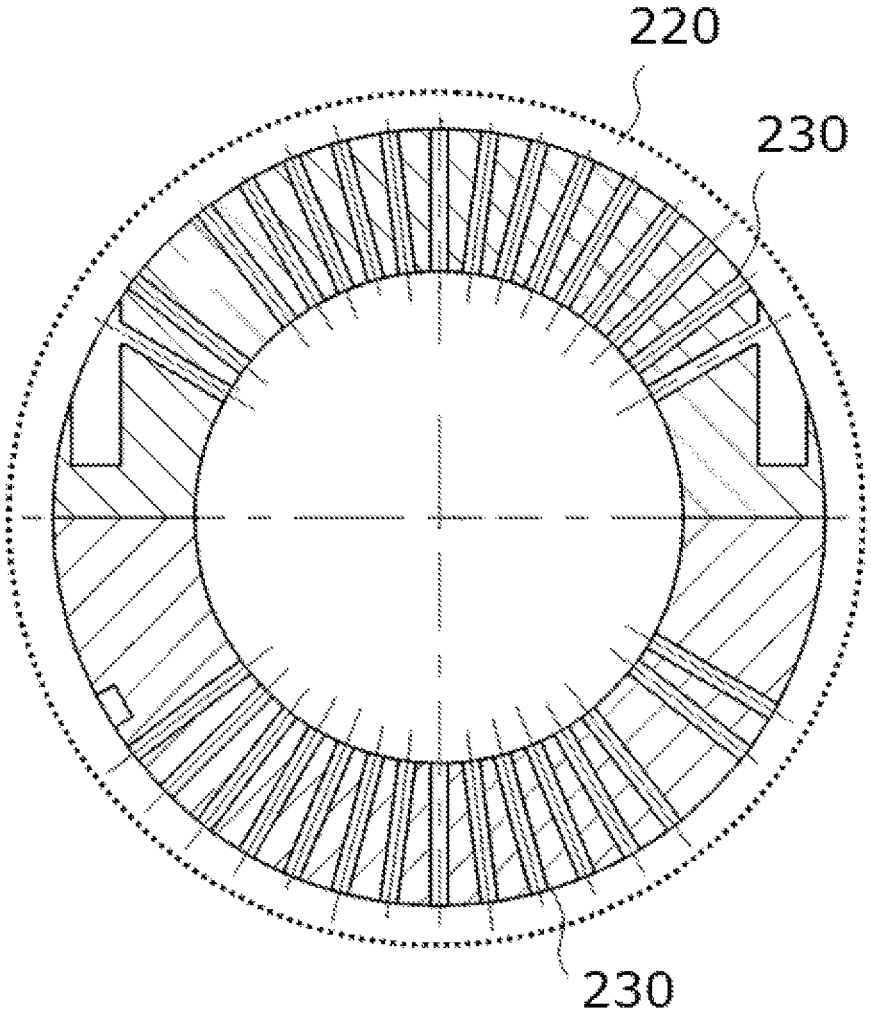
FIG. 6 is a radial sectional view of a steam input channel at the steam throughflow side in the present disclosure.

As shown in FIG. 5 and FIG. 6, the steam turbine comprises an outer casing 110 and an inner casing 120, and a rotor 130 having a thrust balancing piston 140, the rotor 130 being rotatably mounted inside the inner casing 120. A flow channel for a medium (e.g., steam) is formed between the inner casing 120 and the rotor 130, the flow channel substantially running along the axial direction of the rotor 130. The flow channel is alternately arranged with impeller blades 150 fitted with the rotor 130 and guide blades 160 fitted with the inner casing 120, forming multiple stages of blade groups. The inner casing 120 and the outer casing 110 are provided with a live stream feed channel (not shown) via which the live steam is admitted into the inlet steam chamber 350 where the live steam enters the flow channel and circulates downstream around respective blade stage; with expansion and cooling of the live steam, heat energy is released to drive the rotor 130 to rotate.

In this embodiment, with the first steam channel configured, the steam is enabled to flow into a thrust balancing piston chamber 340 between the thrust balancing piston 140 and the inner casing 120 from the steam throughflow 330 when coursing through the flow channel, generating a counter force reacting against a rotor thrust, thereby achieving thrust balance and cooling the thrust balancing piston 140.

In this embodiment, by further providing a second steam channel, the steam (e.g., a small portion of leakage steam from the live steam) is admissible into a steam supplementing chamber 220 between the inner casing 120 and the outer casing 110 from a sealed chamber 310 between the rotor 130 and the inner casing 120 (steam-tightness), so as to be mixed with the supplemental steam externally fed into the steam supplementing chamber 220 via the steam supplementing pipelines so as to balance, in the steam supplementing chamber 220, the throughput and pressure differentials of the supplemental steam entering the steam turbine from the two lines of steam supplementing pipelines; after the vibration excitation is eliminated, the steam is introduced into the blade staging downstream of the steam throughflow 330 via the communicating pipelines 230 evenly distributed in the circumference of the inner casing 120 to continue working, solving the vibration occurring upon opening the steam supplementing valve.

The steam supplementing chamber 220 is arranged surrounding the outer side of the inner casing 120. The steam supplementing chamber 220 may be a spatial structure of any shape, which is defined by the shapes of the casing bodies of the outer casing 110 and the inner casing 120 at that position. Preferably, the steam supplementing chamber 220 is an annular steam supplementing chamber. In this way, a section of the interlayer between the inner casing and the outer casing for the steam to circulate forms the steam supplementing chamber 220. In FIG. 5, the arrow 210 represents that one line of the steam supplementing pipelines accesses the region of the interlayer where the steam supplementing chamber 220 is located so as to feed the supplemental steam.

The exemplary steam supplementing chamber 220 is located at the downstream segment of the interlayer, i.e., the side closer to the communicating pipe 230, wherein the closer to that side, the larger the volume of the steam supplementing chamber 220 is. FIG. 5 reflects that the closer the steam supplementing chamber 220 is to the communicating pipe 230, the greater the ring width of the cross section of the steam supplementing chamber 220 is. For example, by changing the structural design of the outer side of the inner casing 120, the inner diameter of the inner casing section corresponding to the position of the steam supplementing chamber 220 is diminished gradually.

In this example, the shape/size design of the steam supplementing chamber, the location of the steam supplementing chamber in the interlayer between the inner casing and the outer casing, and the access location/supplemental steam throughput from the steam supplementing pipelines to the steam supplementing chamber may be adjusted according to actual application conditions of the steam turbine disclosed by the present disclosure; the depictions in the examples above are not limiting.

Exemplarily, a corresponding pipeline for the first steam channel is provided in the inner casing 120, such that the steam can start from downstream of one blade staging (referred to as the first designated blade staging) corresponding to the steam throughflow 330; the pipeline first extends perpendicular to the axial direction (schematically represented by arrow 411), and after the first turn, extends substantially parallel to the axial direction (schematically represented by the arrow 422), and then after the second turn, extends substantially perpendicular to the axial direction (schematically represented by the arrow 413), till entering the thrust balancing piston chamber 340.

Exemplarily, the second steam channel includes a pipeline connecting the sealed chamber 310 to the interlayer between the inner casing and the outer casing, the interlayer between the inner casing and the outer casing, the steam supplementing chamber 220 formed in the interlayer, and a pipeline (including the communicating pipe 230) connecting the interlayer between the inner casing and the outer casing to the flow channel. Arrow 511 schematically represents that the steam starts from the sealed chamber 310, extending substantially perpendicular to the axial direction into the interlayer between the inner casing and the outer casing; Arrow 512 schematically represents that the steam extends in the upstream segment of the interlayer between the inner layer and the outer layer along the axial direction, and mixes, when coursing through the steam supplementing chamber 220 in the downstream segment, with the supplemental steam additionally fed thereinto (schematically represented by the arrow 210), and continues extending till being admitted into the communication pipe 230; Arrow 513 schematically represents that the steam extends substantially perpendicular to the axial direction again along the communicating pipe 230 till entering the flow channel to access the steam throughflow 320 downstream of another blade staging (referred to the second designated blade staging).

In this example, the second designated blade staging disposed downstream of the first designated blade staging refers to one blade stage downstream of the first designated blade staging. In a preferred example, the first designated blade staging corresponds to the fourth blade stage in the flow channel, and the second designated blade staging corresponds to the fifth blade stage in the flow channel.

However, the present disclosure is not limited to structural adjustment based on the actual application scenarios of the steam turbine, such as changing the shape/size/turn/throughput of respective pipelines for the first and second steam channels, changing respective blade stage corresponding to the first and second designated blade staging, adjusting the number of blade stages between the first and second designated blade staging, or adjusting the feed port (corresponding to where the steam throughflow 300 is located) of the first steam channel to downstream of the output port (corresponding to where the steam throughflow 320 is located) of the second steam channel, etc.

In view of the above, the steam turbine having a steam supplementing structure and the operating method therefor according to the present disclosure changes the steam flow direction in the cooling structure; besides, an appropriate annular steam supplementing chamber is provided between the inner casing and the outer casing, such that the steam may be mixed between the inner casing and the outer casing, which eliminates the throughput and pressure differentials when two lines of supplemental steam are inputted, thereby effectively overcoming the vibration upon opening of the steam supplementing valve when the steam turbine is operating.

Although the contents of the present disclosure have been described in detail through the foregoing preferred embodiments, it should be understood that the depictions above shall not be regarded as limitations to the present disclosure. After those skilled in the art having read the contents above, many modifications and substitutions to the present disclosure are all obvious. Therefore, the protection scope of the present disclosure should be limited by the appended claims.

What is claimed is:

1. A steam turbine having a steam supplementing structure, comprising an outer casing and an inner casing, a rotor having a thrust balancing piston, the rotor being rotatably mounted inside the inner casing; and a steam flow channel formed between the inner casing and the rotor, wherein a plurality of impeller blades fitted with the rotor and a plurality of guide blades fitted with the inner casing are alternately arranged to form multiple stages of blade groups; an interlayer for steam to circulate is formed between the inner casing and the outer casing; wherein:

the interlayer between the inner casing and the outer casing includes a steam supplementing chamber that is connected to a plurality of lines of steam supplementing pipelines for conveying supplemental steam to the steam turbine, so that a plurality of lines of supplemental steam can be mixed in the steam supplementing chamber; and a plurality of lines of communicating pipes for the steam to circulate are provided between the steam supplementing chamber and the flow channel.

2. The steam turbine having a steam supplementing structure according to claim 1, wherein:

the steam supplementing chamber is an annular steam supplementing chamber.

3. The steam turbine having a steam supplementing structure according to claim 1, wherein:

the multiple stages of blade groups include a first set blade staging and a second set blade staging; and a sealed chamber is provided between the rotor and the inner casing;

the steam turbine is provided with a first steam channel inside the inner casing, the first steam channel connecting the steam throughflow downstream of the first set blade staging to a thrust balancing piston chamber formed between the thrust balancing piston and the inner casing; and the steam turbine is further provided with a second steam channel, the second steam channel comprising: a pipeline connecting the sealed chamber to the interlayer between the inner casing and the outer casing, the interlayer, the steam supplementing chamber of the interlayer, and the plurality of lines of communicating pipes connecting the interlayer to the steam throughflow downstream of the second set blade staging.

4. The steam turbine having a steam supplementing structure according to claim 3, wherein:

the second set blade staging is disposed downstream of the first set blade staging in the flow channel.

5. The steam turbine having a steam supplementing structure according to claim 3, wherein:

the first set blade staging corresponds to the fourth blade stage in the flow channel, and the second set blade staging corresponds to the fifth blade stage in the flow channel.

6. The steam turbine having a steam supplementing structure according to claim 3, wherein:

the plurality of lines of communicating pipes are distributed at the circumference of the inner casing.

7. The steam turbine having a steam supplementing structure according to claim 3, wherein:

the first steam channel first extends in the inner casing in the axial direction substantially perpendicular to the rotor, and after the first turn, extends substantially parallel to the axial direction, and then after the second turn, extends substantially perpendicular to the axial direction; and in the second steam channel, a pipeline connecting the sealed chamber to the interlayer between the inner casing and the outer casing extends along the axial direction substantially perpendicular to the rotor, and a communicating pipe connecting the interlayer to the steam throughflow downstream of the second set blade staging extends substantially perpendicular to the axial direction.

8. The steam turbine having a steam supplementing structure according to claim 3, wherein:

a plurality of lines of the steam supplementing pipelines pass through the outer casing, respectively, to communicate with the steam supplementing chamber.

9. An operating method for a steam turbine, applicable to the steam turbine having a steam supplementing structure according to claim 1, an inner casing and an outer casing of the steam turbine being provided with a live steam feed channel, the method comprising:

feeding live steam into an inlet steam chamber inside the inner casing via the live steam feed channel, wherein the live steam starts from the inlet steam chamber into a flow channel between the inner casing and the rotor, and circulates around respective blade stage so as to be expanded and cooled, thereby releasing heat energy to drive the rotor to rotate;

conveying, via a first steam channel provided in the inner casing of the steam turbine, the steam from the steam throughflow downstream of a first designated blade staging in multiple stages of blade groups to a thrust balancing piston chamber disposed between the inner casing and the thrust balancing piston of the rotor so as to generate a counter force reacting to a rotor thrust;

conveying, via a second steam channel of the steam turbine, the steam from the sealed chamber disposed between the rotor and the inner casing into the steam supplementing chamber in the interlayer between the inner casing and the outer casing so as to mix with the supplemental steam externally fed into the steam supplementing chamber via a plurality of lines of steam supplementing pipelines, wherein the mixed steam then returns from the plurality of lines of communicating pipes disposed in the inner casing to the steam throughflow downstream of the second designated blade staging to continue working.

10. The operating method for a steam turbine according to claim 9, wherein:

the steam supplementing chamber is an annular steam supplementing chamber.

11. The operating method for a steam turbine according to claim 9, wherein:

the multiple stages of blade groups include a first set blade staging and a second set blade staging; and a sealed chamber is provided between the rotor and the inner casing;

the steam turbine is provided with a first steam channel inside the inner casing, the first steam channel connecting the steam throughflow downstream of the first set blade staging to a thrust balancing piston chamber formed between the thrust balancing piston and the inner casing; and the steam turbine is further provided with a second steam channel, the second steam channel comprising: a pipeline connecting the sealed chamber to the interlayer between the inner casing and the outer casing, the interlayer, the steam supplementing chamber of the interlayer, and the plurality of lines of communicating pipes connecting the interlayer to the steam throughflow downstream of the second set blade staging.

12. The operating method for a steam turbine according to claim 11, wherein:

the second set blade staging is disposed downstream of the first set blade staging in the flow channel.

13. The operating method for a steam turbine according to claim 11, wherein:

the first set blade staging corresponds to the fourth blade stage in the flow channel, and the second set blade staging corresponds to the fifth blade stage in the flow channel.

14. The operating method for a steam turbine according to claim 11, wherein:

the plurality of lines of communicating pipes are distributed at the circumference of the inner casing.

15. The operating method for a steam turbine according to claim 11, wherein:

the first steam channel first extends in the inner casing in the axial direction substantially perpendicular to the rotor, and after the first turn, extends substantially parallel to the axial direction, and then after the second turn, extends substantially perpendicular to the axial direction; and in the second steam channel, a pipeline connecting the sealed chamber to the interlayer between the inner casing and the outer casing extends along the axial direction substantially perpendicular to the rotor, and a communicating pipe connecting the interlayer to the steam throughflow downstream of the second set blade staging extends substantially perpendicular to the axial direction.

16. The operating method for a steam turbine according to claim 11, wherein:

a plurality of lines of the steam supplementing pipelines pass through the outer casing, respectively, to communicate with the steam supplementing chamber.

* * * * *